US009708873B2

(12) United States Patent
Hallundbæk

(10) Patent No.: US 9,708,873 B2
(45) Date of Patent: Jul. 18, 2017

(54) HYDRAULIC ASSEMBLY

(75) Inventor: Jørgen Hallundbæk, Græsted (DK)

(73) Assignee: Welltec A/S, Allerød (DK)

( * ) Notice: Subject to any disclaimer, the term of this patent is extended or adjusted under 35 U.S.C. 154(b) by 338 days.

(21) Appl. No.: 14/007,657

(22) PCT Filed: Mar. 29, 2012

(86) PCT No.: PCT/EP2012/055643
§ 371 (c)(1),
(2), (4) Date: Sep. 26, 2013

(87) PCT Pub. No.: WO2012/130944
PCT Pub. Date: Oct. 4, 2012

(65) Prior Publication Data

US 2014/0014363 A1 Jan. 16, 2014

(30) Foreign Application Priority Data

Mar. 30, 2011 (EP) ..... 11160551

(51) Int. Cl.
*E21B 23/04* (2006.01)
*E21B 23/14* (2006.01)
*E21B 23/00* (2006.01)

(52) U.S. Cl.
CPC ..... *E21B 23/04* (2013.01); *E21B 23/14* (2013.01); *E21B 2023/008* (2013.01)

(58) Field of Classification Search
CPC ..... E21B 2023/008; E21B 23/14
See application file for complete search history.

(56) References Cited

U.S. PATENT DOCUMENTS 6,273,189 B1 8/2001 Gissler et al.
2010/0012315 A1 1/2010 Mcinally
(Continued)

FOREIGN PATENT DOCUMENTS

CN 201507258 U 6/2010
CN 201521289 U 7/2010
(Continued)

OTHER PUBLICATIONS

International Search Report for PCT/EP2012/055643, mailed May 16, 2012.
(Continued)

*Primary Examiner* — Kenneth L Thompson
*Assistant Examiner* — Steven MacDonald
(74) *Attorney, Agent, or Firm* — Nixon & Vanderhye P.C.

(57) ABSTRACT

The present invention relates to a downhole tool, comprising a hydraulic assembly, an arm assembly, the arm assembly comprising a wheel, a hydraulic motor for rotating the wheel, thereby driving the downhole tool in a forward direction, and a hydraulic pump unit for simultaneous generation of a first and a second pressurized fluid, characterized in that the arm assembly is movable between a retracted position and a projecting position in relation to the tool housing, and the downhole tool furthermore comprises an arm activation assembly for moving the arm assembly between the retracted position and the projecting position, and the hydraulic motor drives the downhole tool in the forward direction when the arm assembly is in the projecting position, the arm activation assembly being in fluid connection with the first pressurized fluid and the hydraulic motor being in fluid connection with the second pressurized fluid, a hydraulic control block for controlling the pressure of the first pressurized fluid having a first pressure and controlling a second pressure of the second pressurized fluid, and a
(Continued)

hydraulic control block comprising a first sequential valve for controlling a sequence of retraction of the arm assembly, a projection of the arm assembly and a rotation of the wheel, wherein the sequential valve is fluidly connected with one of the fluids and changes between an open and a closed position based upon the pressure of the other fluid. Furthermore, the present invention relates to a method of controlling a projection of an arm assembly of a driving unit of a downhole tool and to a downhole system.

20 Claims, 8 Drawing Sheets

(56) References Cited

U.S. PATENT DOCUMENTS

| | | | | |
|---|---|---|---|---|
| 2011/0271669 | A1* | 11/2011 | Kawasaki | E02F 9/2075 60/414 |
| 2012/0037358 | A1 | 2/2012 | Ferkingstad et al. | |

FOREIGN PATENT DOCUMENTS

| | | | |
|---|---|---|---|
| RU | 2 034 140 | C1 | 4/1995 |
| RU | 2 236 549 | C2 | 9/2004 |
| RU | 2 341 639 | C2 | 12/2008 |
| RU | 2 354 801 | C2 | 5/2009 |
| WO | WO 93/18277 | | 9/1993 |
| WO | WO 2004/097163 | A1 | 11/2004 |
| WO | WO 2006/115418 | | 11/2006 |
| WO | WO 2008/091157 | | 7/2008 |
| WO | WO 2008/111844 | | 9/2008 |
| WO | WO 2009/020397 | | 2/2009 |
| WO | WO 2010/123375 | | 10/2010 |

OTHER PUBLICATIONS

Written Opinion for PCT/EP2012/055643, mailed May 16, 2012.
International Preliminary Report on Patentability issued in International Patent Application No. PCT/EP2012/055643 issued on Oct. 1, 2013.

* cited by examiner

HYDRAULIC ASSEMBLY

This application is the U.S. national phase of International Application No. PCT/EP2012/055643 filed 29 Mar. 2012 which designated the U.S. and claims priority to EP Patent Application No. 11160551.5 filed 30 Mar. 2011, the entire contents of each of which are hereby incorporated by reference.

FIELD OF THE INVENTION

The present invention relates to a downhole tool, comprising a hydraulic assembly, an arm assembly comprising a wheel, a hydraulic motor for rotating the wheel, thereby driving the downhole tool in a forward direction, and a hydraulic pump unit for simultaneous generation of a first and a second pressurised fluid. Furthermore, the present invention relates to a method of controlling a projection of an arm assembly of a driving unit of a downhole tool and to a downhole system.

BACKGROUND ART

Downhole tools are used for operations inside boreholes of oil and gas wells. Downhole tools operate in a very harsh environment and must be able to withstand inter alia corroding fluids, high temperatures and high pressure.

To avoid unnecessary and expensive disturbances in the production of oil and gas, the tools deployed downhole have to be reliable and easy to remove from the well in case of a breakdown. Tools are often deployed at great depths several kilometers down the well, and removing jammed tools are therefore a costly and time-consuming operation.

It is known to control hydraulic engines in a hydraulic system by means of control valves and/or sequence valves, which are coupled in between the engines and the respective pumps. In downhole equipment control is limited for the user due to the special situation many kilometers down the borehole. Furthermore, the control of such equipment has to be independent of surface control in case of breakdowns in communication between equipment and surface, so that tools engaging the borehole wall or production casing by hydraulic means may still be retracted from the well in case of breakdowns. Therefore, a need for highly reliant control systems exists which may be advantageously utilised in the design of fail-safe downhole control systems.

SUMMARY OF THE INVENTION

It is an object of the present invention to wholly or partly overcome the above disadvantages and drawbacks of the prior art. More specifically, it is an object to provide an improved downhole tool which does not get stuck when activating its wheels on projecting arms in order to propel itself forward in the well.

The above objects, together with numerous other objects, advantages, and features, which will become evident from the below description, are accomplished by a solution in accordance with the present invention by a downhole tool, comprising:

- a hydraulic assembly,
- an arm assembly, the arm assembly comprising a wheel,
- a hydraulic motor for rotating the wheel, thereby driving the downhole tool in a forward direction, and
- a hydraulic pump unit for simultaneous generation of a first and a second pressurised fluid, characterised in that the arm assembly is movable between a retracted position and a projecting position in relation to the tool housing, and the downhole tool furthermore comprises:

- an arm activation assembly for moving the arm assembly between the retracted position and the projecting position, and the hydraulic motor drives the downhole tool in the forward direction when the arm assembly is in the projecting position, the arm activation assembly being in fluid connection with the first pressurised fluid and the hydraulic motor being in fluid connection with the second pressurised fluid,
- a hydraulic control block for controlling the pressure of the first pressurised fluid having a first pressure and controlling a second pressure of the second pressurised fluid, and
- the hydraulic control block comprising a sequential valve for controlling a sequence of retraction of the arm assembly, a projection of the arm assembly and a rotation of the wheel, wherein the sequential valve is fluidly connected with one of the fluids and changes between an open and a closed position based upon the pressure of the other fluid.

In one embodiment, the first and second pressurised fluids may be reunited downstream from the arm activation assembly and the hydraulic motor, respectively, into downstream fluid entering a fluid hydraulic chamber connected with the hydraulic pump in a closed circuit.

In another embodiment, the hydraulic assembly may comprise a hydraulic assembly housing being the hydraulic chamber wherein the hydraulic block and the hydraulic pump are contained.

Furthermore, the hydraulic block and the hydraulic pump may be contained in the hydraulic assembly housing further comprising sensors for monitoring the first and second pressures for producing a feedback signal to a control system.

In addition, the sequential valve may be fluidly connected with the second fluid and changes between an open and a closed position based upon the pressure of the first fluid.

Also, the sequential valve may be fluidly connected with the first fluid and changes between an open and a closed position based upon the pressure of the second fluid measured upstream of a throttle.

The first pressurised fluid may be in fluid communication with a direction valve through a pilot connection, the hydraulic motor having first and second inlet ports, the direction valve controlling the second fluid entering in the first or the second inlet ports of the hydraulic motor, so that a direction of rotation of the hydraulic motor may be controlled by the first fluid to be in a forward or reverse mode.

In another embodiment, the hydraulic block may further comprise an additional sequential valve fluidly connected with the second fluid, so that the second fluid passes through the additional valve before being fed to the arm activation assembly.

Furthermore, the hydraulic pump unit or motor may be powered through a wireline or receive fluid through tubing.

The downhole tool according to the invention may comprise a plurality of wheels.

Also, the downhole tool according to the invention may comprise a plurality of arm assemblies.

Moreover, the wheels may be driven from a hydraulic motor contained within the driving unit housing.

Further, a downhole tool according to the invention may comprise an arm assembly with internal fluid channels.

In one embodiment, the hydraulic block may comprise a first and second pressure controlling means for controlling the first and second pressures.

The downhole tool according to the invention may be connected with a wireline, such as coil tube or drill pipe.

In addition, the downhole tool according to the invention may comprise sensors for monitoring the first and second pressures for producing a feedback signal to a control system.

The present invention further relates to a method of controlling a projection of an arm assembly of a driving unit of a downhole tool, comprising activation of a hydraulic pump, simultaneous generation of a first pressurised fluid having a first pressure and a second pressurised fluid having a second pressure, activation of a rotation of a hydraulic motor by the first pressurised fluid for driving a wheel of the arm assembly, increasing the first pressure until the first pressure reaches a predetermined projection pressure, activation of an arm activation assembly by a first sequential valve, and activation of a projection of the arm assembly by the second pressure of the second pressurised fluid.

Also, the invention relates to a method as described above, further comprising the steps of:

forcing the second fluid through an orifice and into a first sequential valve, thereby gradually closing the first sequential valve and replacing the step of activation of an arm activation assembly by the first sequential valve, increasing the second pressure upstream of the orifice, gradually closing a second sequential valve by increasing the second pressure of the second fluid, increasing the first pressure of the first fluid, replacing the step of increasing the first pressure until the first pressure reaches a predetermined projection pressure, increasing the second pressure further when the wheel of the arm assembly abuts an inner wall of the borehole or production casing, closing the second sequential valve by the second pressure, further increasing the first pressure of the first fluid until a maximum pressure of the first pressure of the first fluid is obtained, and driving a tool string in a forward direction.

In one embodiment, the activation of the projection of the arm assembly may occur when the pressure of the second pressurised fluid surmounts a spring force applied to the arm activation assembly by a spring member.

Additionally, the method described above may comprise deactivation of a hydraulic pump, deactivation of a projection of the arm assembly by a decrease of a second pressure of a second pressurised fluid, decreasing the second pressure until the arm assembly is retracted, and decreasing a rotation of a hydraulic motor by decreasing the first pressure of a first pressurised fluid driving a wheel of the arm assembly in which the hydraulic motor is arranged.

In one embodiment, the activation of the retraction of the arm assembly may occur when the pressure of the second pressurised fluid becomes inferior to a spring force applied to the arm activation assembly by a spring member.

Moreover, the present invention relates to a method as described above comprising activation of a hydraulic pump, simultaneous generation of a first pressurised fluid having a first pressure and a second pressurised fluid having a second pressure, activation of a rotation of a hydraulic motor by the first pressurised fluid for driving a wheel of the arm assembly, increasing the first pressure until the first pressure reaches a predetermined projection pressure, activation of an arm activation assembly by a first sequential valve, and activation of a projection of the arm assembly by the second pressure of the second pressurised fluid, driving the downhole tool in a forward direction, deactivation of the hydraulic pump, deactivation of the projection of the arm assembly by decreasing the second pressure of a second pressurised fluid, decreasing the second pressure until the arm assembly is retracted, and decreasing the rotation of the hydraulic motor by decreasing the first pressure of the first pressurised fluid.

Additionally, the present invention relates to a method of controlling a projection of an arm assembly of a driving unit of a downhole tool, comprising activation of a hydraulic pump, simultaneous generation of a first pressurised fluid having a first pressure and a second pressurised fluid having a second pressure, forcing the second fluid through an orifice and into a first sequential valve, thereby gradually closing the first sequential valve, increasing the second pressure upstream of the orifice, gradually closing a second sequential valve by increasing the second pressure of the second fluid, increasing the first pressure of the first fluid, activation of a rotation of a hydraulic motor by the first pressurised fluid for driving a wheel of the arm assembly, activation of a projection of the arm assembly by the second pressure of the second pressurised fluid, increasing the second pressure further when the wheel of the arm assembly abuts an inner wall of the borehole or production casing, closing the second sequential valve by the second pressure, further increasing the first pressure of the first fluid until a maximum pressure of the first pressure of the first fluid is obtained, and driving a tool string in a forward direction.

The present invention furthermore relates to a method of controlling a projection of an arm assembly of a driving unit of a downhole tool, comprising activation of a hydraulic pump, simultaneous generation of a first pressurised fluid having a first pressure and a second pressurised fluid having a second pressure, activation of an arm activation assembly by the second pressurised fluid instead of by a first sequential valve, activation of a projection of the arm assembly by the second pressure of the second pressurised fluid, increasing the second pressure when a wheel of the arm assembly abuts an inner wall of the borehole or production casing, replacing the step of increasing the first pressure until the first pressure reaches a predetermined projection pressure, and increasing the second pressure until the second pressure reaches a predetermined rotation pressure, wherein the step of activation of a rotation of a hydraulic motor by the first pressurised fluid for driving the wheel of the arm assembly is performed by a first sequential valve, driving the downhole tool in a forward direction, deactivation of the hydraulic pump, decreasing the rotation of the hydraulic motor by decreasing the first pressure of the first pressurised fluid, deactivation of a projection of the arm assembly by decreasing the second pressure of the second pressurised fluid, and decreasing the second pressure until the arm assembly is retracted.

Furthermore, the present invention relates to a downhole system comprising the downhole tool according to the invention and an operational tool connected with the downhole tool for being moved forward in a well or borehole.

Said operational tool may be a stroker tool, a key tool, a milling tool, a drilling tool, a logging tool, etc.

Finally, the retraction of the arm assembly of the downhole tool according to the present invention may be assisted by a spring member.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
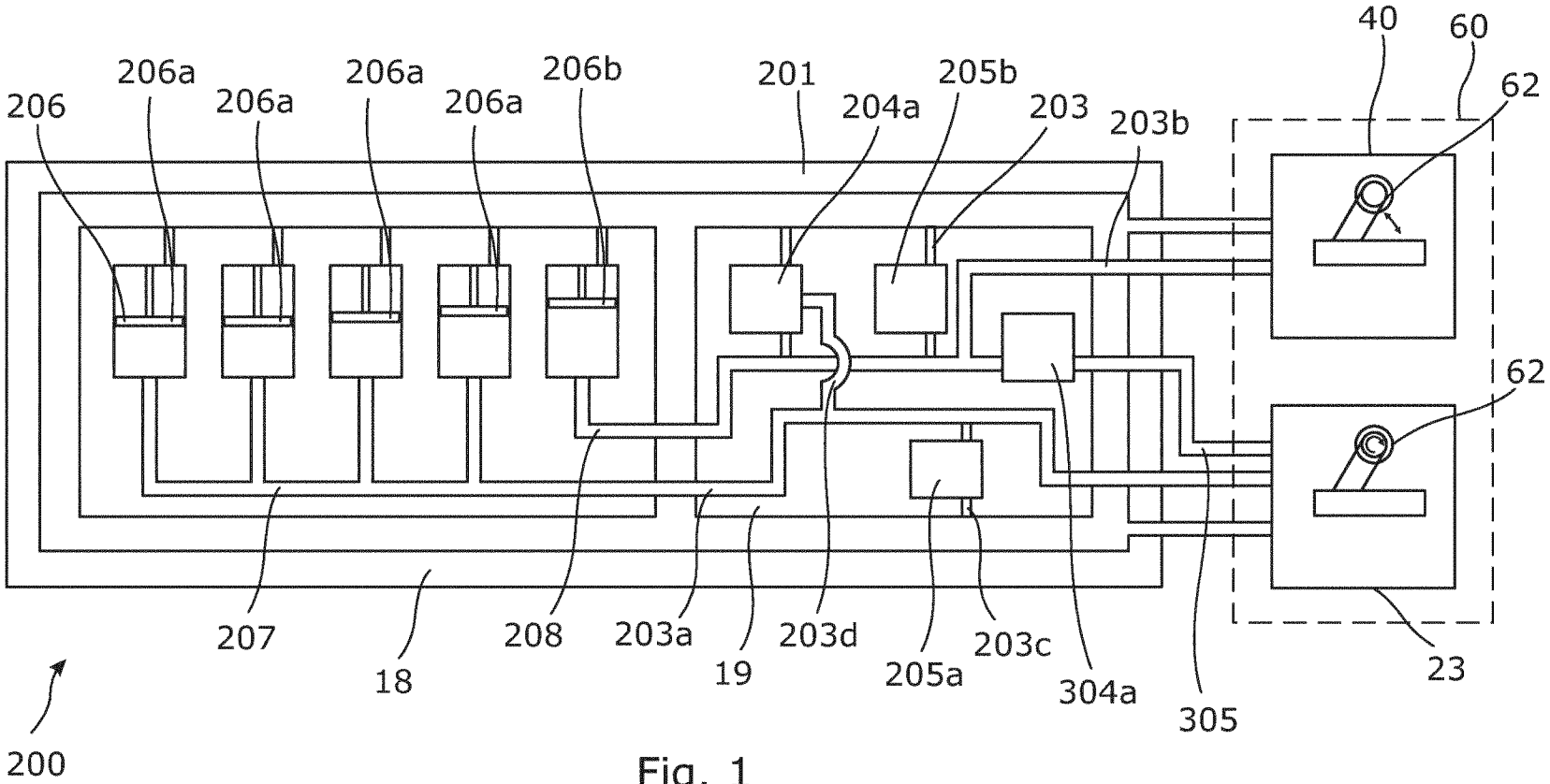
FIG. 1 shows a schematic view of a hydraulic assembly.

FIG. 1 shows a hydraulic assembly 200 of a downhole tool 12 for controlling a sequence of hydraulically driven functions in the downhole tool. The hydraulic assembly 200 is attached to a driving unit 11 for propagating a tool string 10 during downhole operations. The hydraulic assembly 200 provides a plurality of pressurised fluids for propelling the driving unit 11. The driving unit comprises at least one arm assembly and at least one arm activation assembly for moving the arm assembly between a projecting and a retracted position. The arm assembly comprises a wheel 62 arranged so that when the arm assembly is in its projecting position, the wheel is forced against an inner wall 5 of a borehole 4 or a production casing 6. The pressurised fluids provided by the hydraulic assembly 200 are used to project the arm assembly 60 and rotate the wheel 62. One driving unit often comprises several wheels each activated by means of an arm activation assembly 40. The driving unit shown in FIG. 1 comprises four arm assemblies and four arm activation assemblies.

Figure 4:
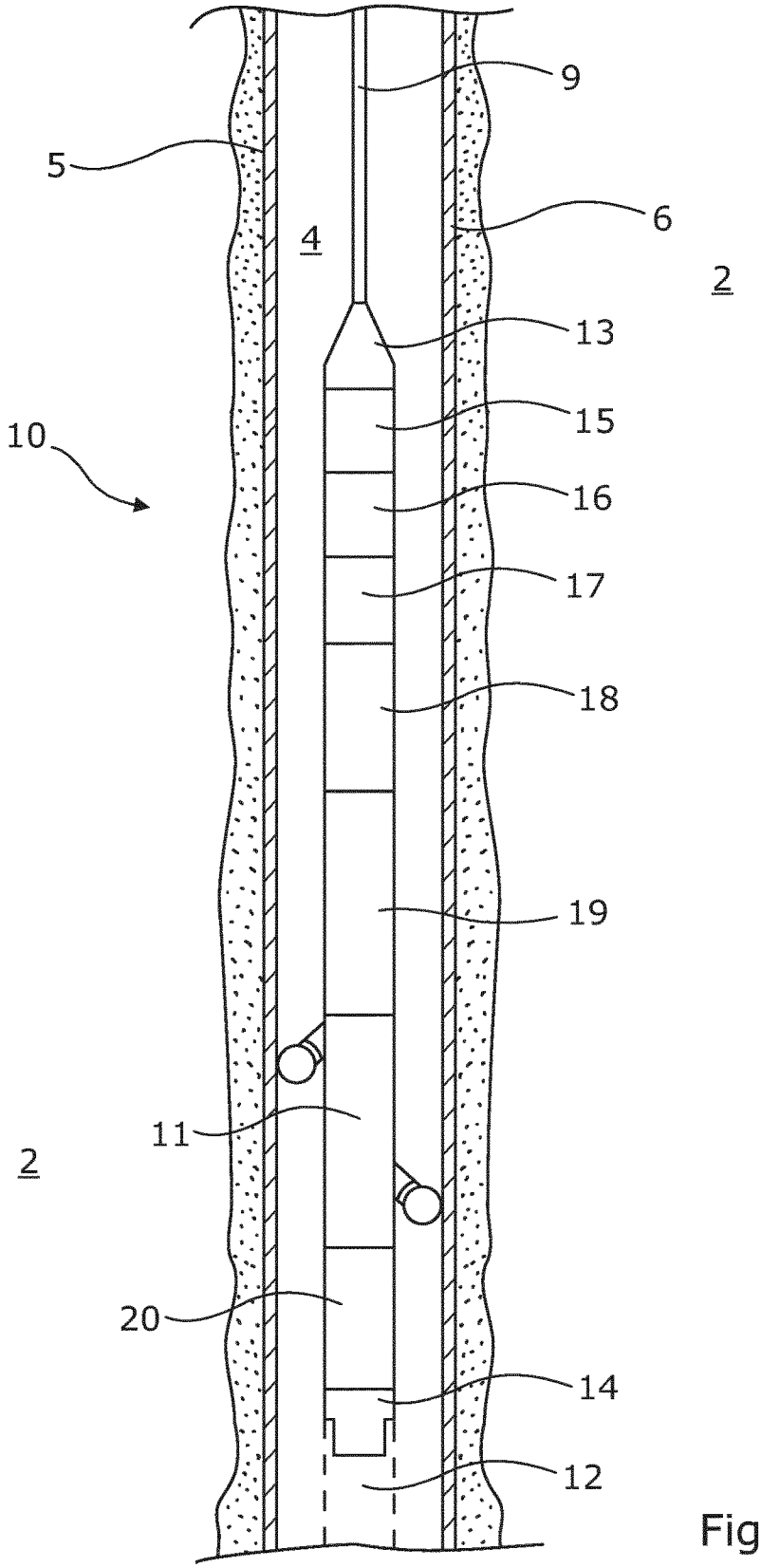
FIG. 4 shows a downhole tool string comprising a hydraulic assembly.

The hydraulic assembly 200 comprises a hydraulic assembly housing 201 and a hydraulic chamber 202 sealed from the surroundings of the hydraulic assembly housing. Thus, the hydraulic assembly housing 201 functions as the hydraulic chamber 202. In this way the housing 201 is filled with hydraulic fluid and is therefore substantially incompressible when exposed to high pressures downhole. A hydraulic pump 18 is arranged in and in fluid communication with the hydraulic chamber inside the hydraulic assembly housing 201. The hydraulic pump shown in FIG. 1 comprises five hydraulic pistons 206, four first hydraulic pistons 206*a* arranged in parallel fluid connection for pressurising a first pressurised fluid 207 and one second hydraulic piston 206*b* for pressurising a second pressurised fluid 208. The hydraulic pump 18 is thus several pump sections driven by an electrical motor 17 in a conventional way and receiving power through a wireline 9 as shown in FIG. 4. The hydraulic assembly 200 has a fluid connection with an arm activation assembly 40 for moving the arm assembly between a retracted position and a projecting position in relation to a driving unit housing 54 by the second pressurised fluid 208. The wheel of the arm assembly may engage the inner side of the borehole or the production casing in the projecting position. Furthermore, the hydraulic assembly 200 has a fluid connection with a hydraulic motor 23 for driving the wheel 62 of the arm assembly 60, thereby driving the downhole tool in a forward direction when the arm assembly is in the projecting position. The hydraulic assembly 200 furthermore comprises a hydraulic block 19 arranged in and in fluid communication with the hydraulic chamber 202 for controlling a sequence of the first and second pressurised fluids exiting the hydraulic assembly 200. Furthermore, the hydraulic block 19 controls a magnitude of a pressure of the pressurised fluid when the pressurised fluid exits the hydraulic block 19 and enters the arm activation assembly 60 or the hydraulic motor 23. Furthermore, by the hydraulic block 19 and the hydraulic pump 18 comprised in the housing 201 being filled with hydraulic fluid, both the hydraulic block 19 and the hydraulic pump 18 are protected from the surrounding high pressures downhole, and stable fluid connections in the hydraulic assembly are ensured.

Figure 5A:
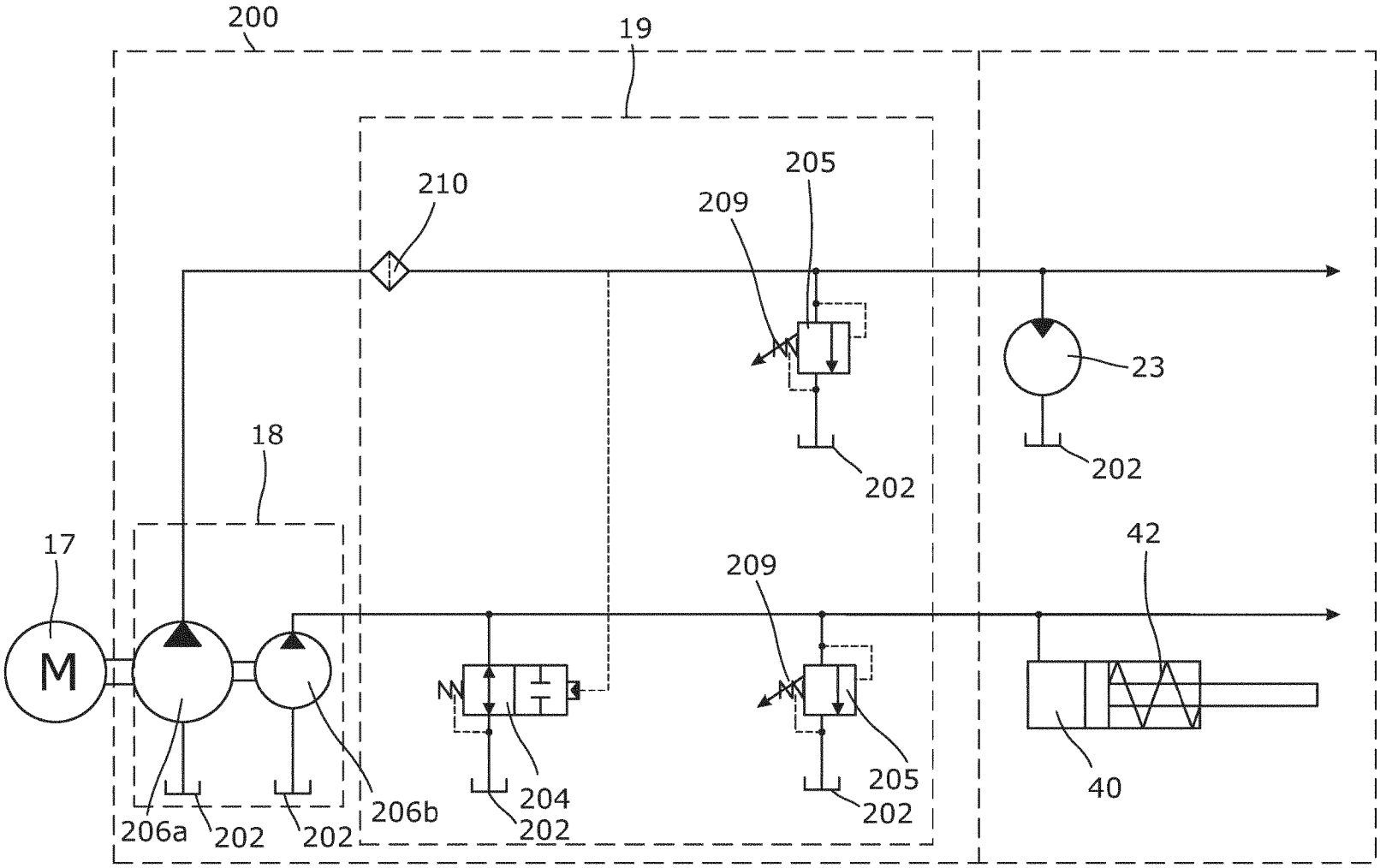
FIGS. 5*a-d* show hydraulic diagrams of different embodiments of hydraulic assemblies.

In FIGS. 1 and 5*a*, the hydraulic block 19 comprises a plurality of fluid connections 203, a first sequential valve 204*a* and two overpressure valves. A fluid connection 203*a* connects the hydraulic pump 18 with the hydraulic motor 23. The fluid connection 203*a* is fluidly connected to the hydraulic chamber 202 through a first overpressure valve 205*a* to ensure that the pressure of the first pressurised fluid 207 never exceeds a pressure determined by the first overpressure valve. Furthermore, the fluid connection 203*a* is fluidly connected to a first sequential valve 204*a* through a first pressure channel 203*d* enabling the first sequential valve 204*a* to be open when the first pressure of the first pressurised fluid is below a projection pressure. The projection pressure is controlled by the first sequential valve 204*a* and closed when the first pressure exceeds the projection pressure. Furthermore, the hydraulic block comprises a fluid connection 203*b* connecting the hydraulic pump 18 with the arm activation assembly 60. The fluid connection 203*b* is fluidly connected to the hydraulic chamber 202 and a second overpressure valve 205*b* to ensure that the pressure of the second pressurised fluid 208 never exceeds a pressure determined by the second overpressure valve. Furthermore, the fluid connection 203*b* is fluidly connected to the hydraulic chamber 202 through the first sequential valve 204*a*. When the first sequential valve 204*a* is open due to the first pressure of the first pressurised fluid being below a projection pressure controlled by the first sequential valve 204*a*, the second pressurised fluid 208 has access to the hydraulic chamber 202. The second pressurised fluid is therefore fluidly short-circuited to the hydraulic chamber 202 and does not enter the arm activation assembly 40 and will therefore not be able to build up pressure in the arm activation assembly 40 to project the arm assembly 60. When the first sequential valve 204*a* is closed due to the first pressure of the first pressurised fluid being above a projection pressure, the second pressurised fluid 208 has no access to the hydraulic chamber 202, and the second pressurised fluid is therefore not fluidly short-circuited to the hydraulic chamber 202 and will therefore have to enter the arm activation assembly 40, thereby projecting the arm assembly 60.

According to one method of the present invention, the hydraulic pump is initially activated in order to generate the first and second pressurised fluids. During build-up of the pressure, the rotation of the hydraulic motor 23 will be activated by the first pressurised fluid 207. In the early phase of the pressure build-up, the arm activation assembly is still not activated since the first sequential valve is still open and thereby short-circuiting the second pressurised fluid, so that it returns to the hydraulic chamber rather than building up pressure in the arm activation assembly 40. Therefore, the wheels 62 will start rotating before the arm assembly is projected. This start of the sequence has the advantage that the wheels are already rotating and therefore have a certain momentum when the arm assembly is projected and the wheels start to engage the inner wall of the borehole or the production casing. When the first pressure of the first pressurised fluid 207 continues to build up, it will at some point close the first sequential valve 204*a*. The sequential valve 204*a* closes when the first pressure reaches a pressure defined as the projection pressure, since the projection of the arm assembly will initiate when the first sequential valve closes. When the first sequential valve closes, there is no longer passage of the second pressurised fluid 208 directly through the first sequential valve 204*a* to the hydraulic chamber 20. The second pressure of the second pressurised fluid 208 will then start to build up, resulting in the second pressurised fluid 208 applying a projecting force to the arm activation assembly 40 activating the projection of the arm assembly 60.

Furthermore, in some embodiments of the invention, the activation of the projection of the arm assembly may occur when the projecting force of the second pressurised fluid 208 surmounts a retraction spring force applied to the arm activation assembly by a spring member 42. In order to ensure a fail-safe retraction of the arm assembly, the spring member 42 may counter the second pressure of the second pressurised fluid, so that the spring member 42 will assist the arm assembly 60 in the retraction phase. In this way, loss of pressure from the hydraulic assembly 200 will immediately lead to a retraction of the arm assembly 60, thereby preventing jamming of the downhole tool.

According to another method of the present invention, the hydraulic pump 18 is deactivated to initiate a retraction of the arm assembly 60. This will lead to a decrease in the second pressure applied on the arm activation assembly 40, thereby leading to a retraction of the arm assembly 60. Deactivating the hydraulic pump 18 also leads to a decrease in the first pressure. When the first pressure decreases, the rotation of the hydraulic motor 23 will also decrease, and the downhole tool will eventually stop moving.

The first and second pressurised fluids may be merged downstream of the arm activation assembly 40 and downstream of the hydraulic motor 23 in the driving unit 11 before returning to the hydraulic chamber 202.

Fluid enters the hydraulic motor through fluid connection 203*a* in order to force the rotatable section of the hydraulic motor to rotate in one direction and thus rotate the wheels to rotate the downhole tool to propel itself forward in the well. In order to be able to propel both forward and backwards, the rotational direction of the wheel of the downhole tool may be changed. To change direction of the rotation of the wheels 62, the first fluid may be in fluid communication with a direction valve through a pilot connection 305 before entering the hydraulic motor 23. In this embodiment, the hydraulic motor has both first and second inlet ports, and which of the ports the fluid enters is determined by the position of the directional valve, and the position of the directional valve is controlled by the pilot connection. Therefore, if the fluid is directed in the directional valve to enter the first ports, the rotatable section of the hydraulic motor is forced to rotate in one direction, and if the fluid is directed to enter the second ports, the hydraulic motor is forced to rotate in the opposite direction. By having this pilot connection, the direction of rotation of the hydraulic motor 23 may be reversed using the first fluid, so that the direction of rotation of the hydraulic motor may be controlled by the first fluid to be in a forward or reverse mode.

Figure 2:
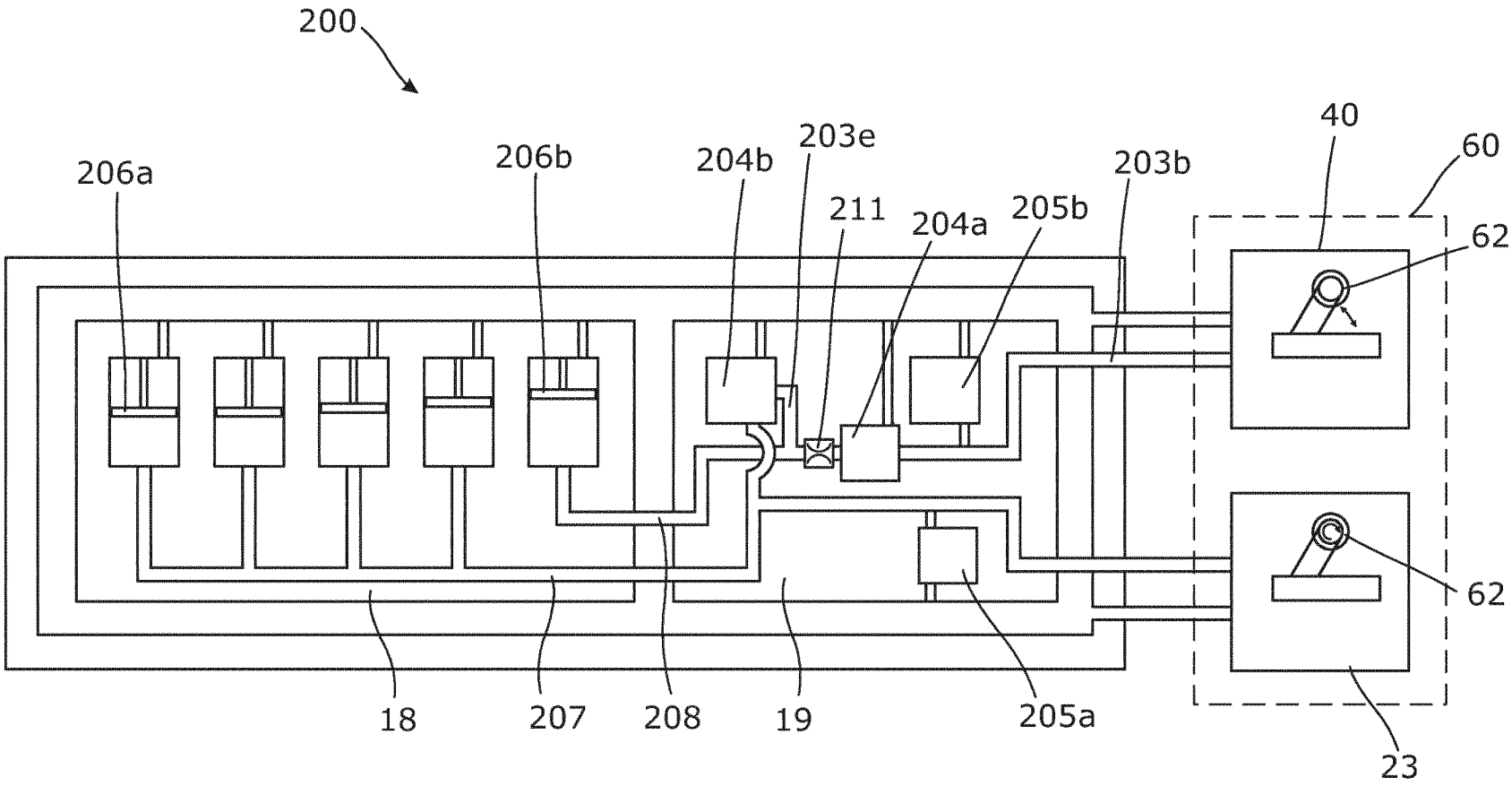
FIG. 2 shows a schematic view of another hydraulic assembly.
Figure 5B:
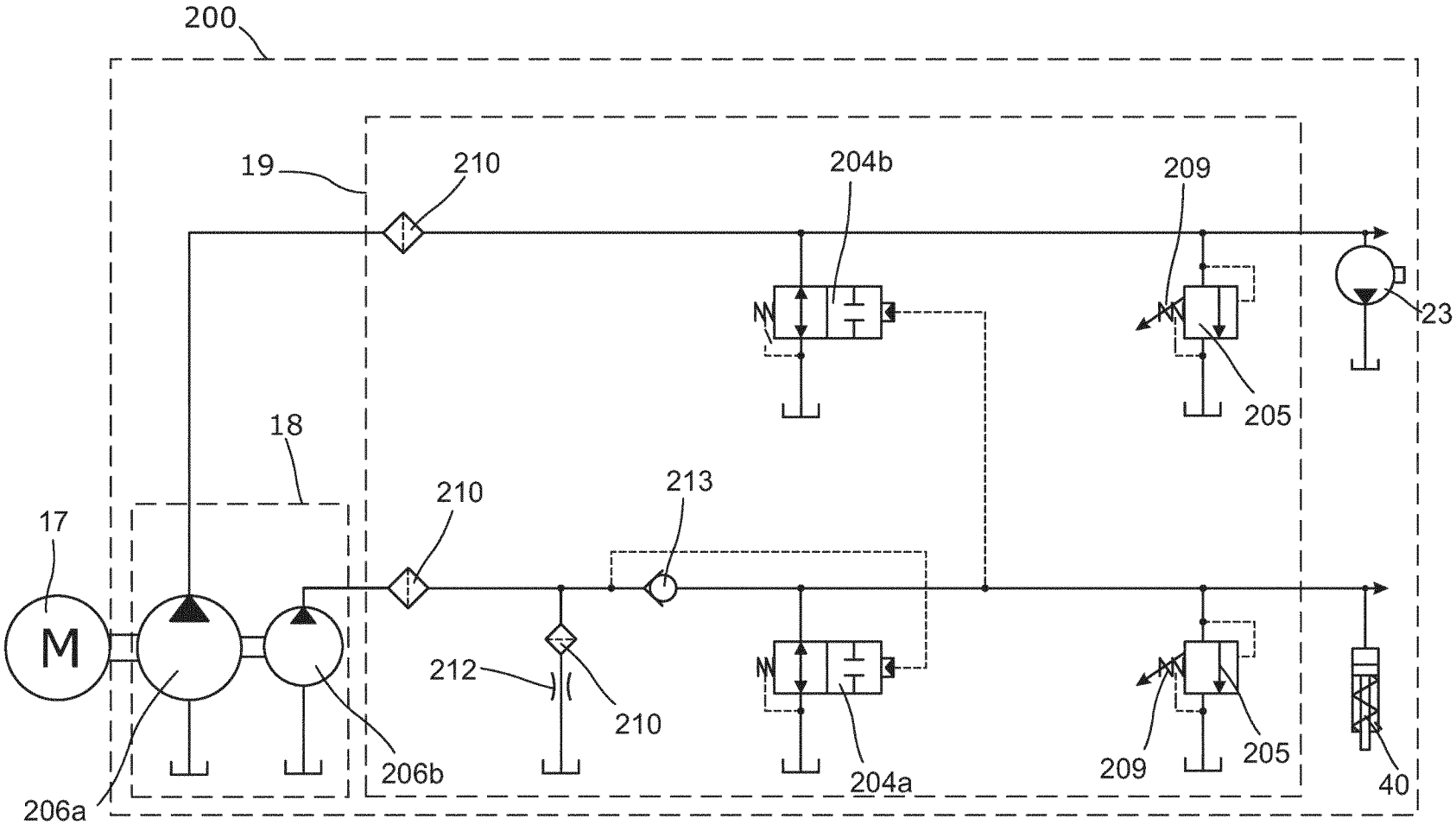
Figure 5C:
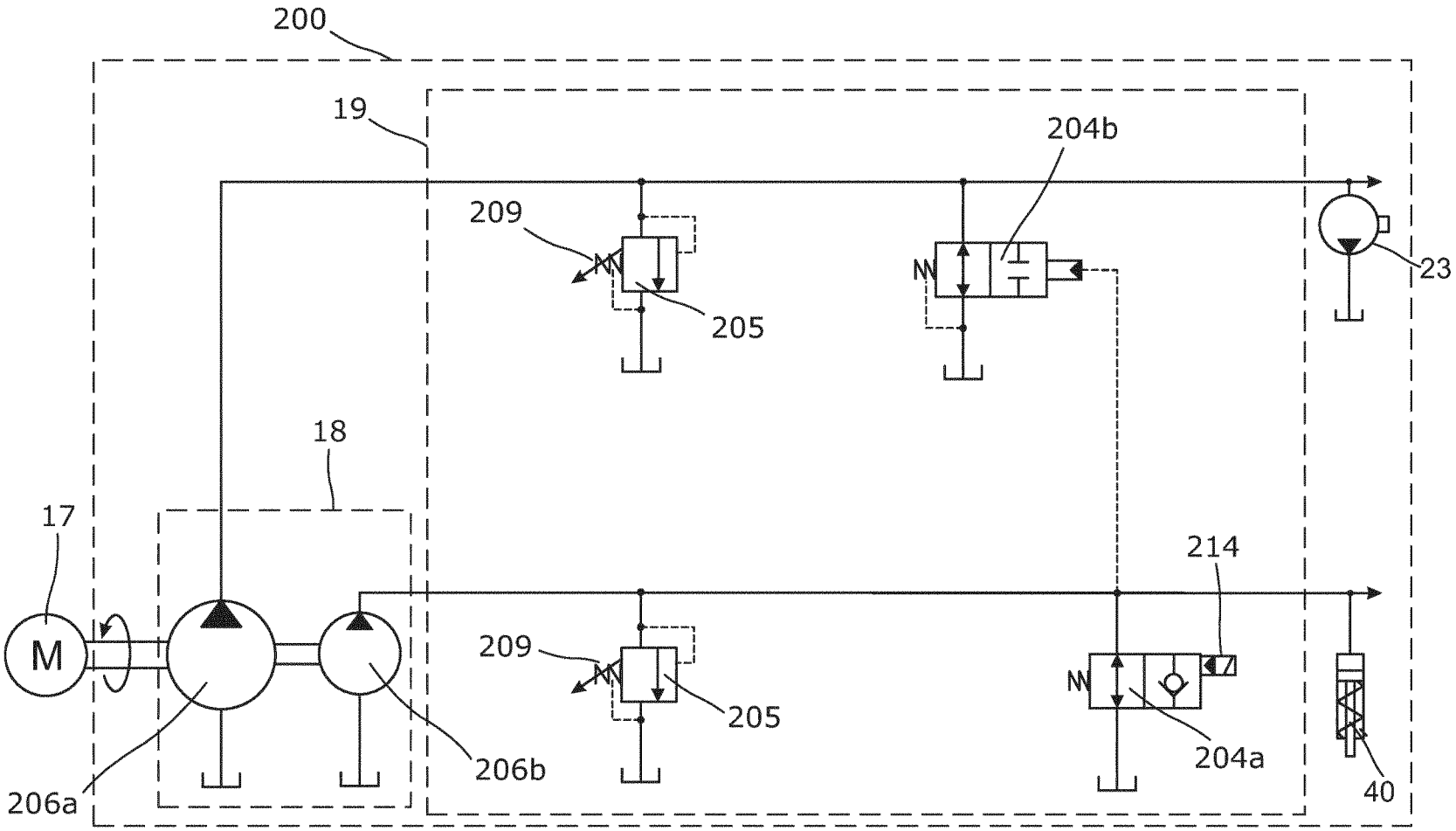
Figure 5D:
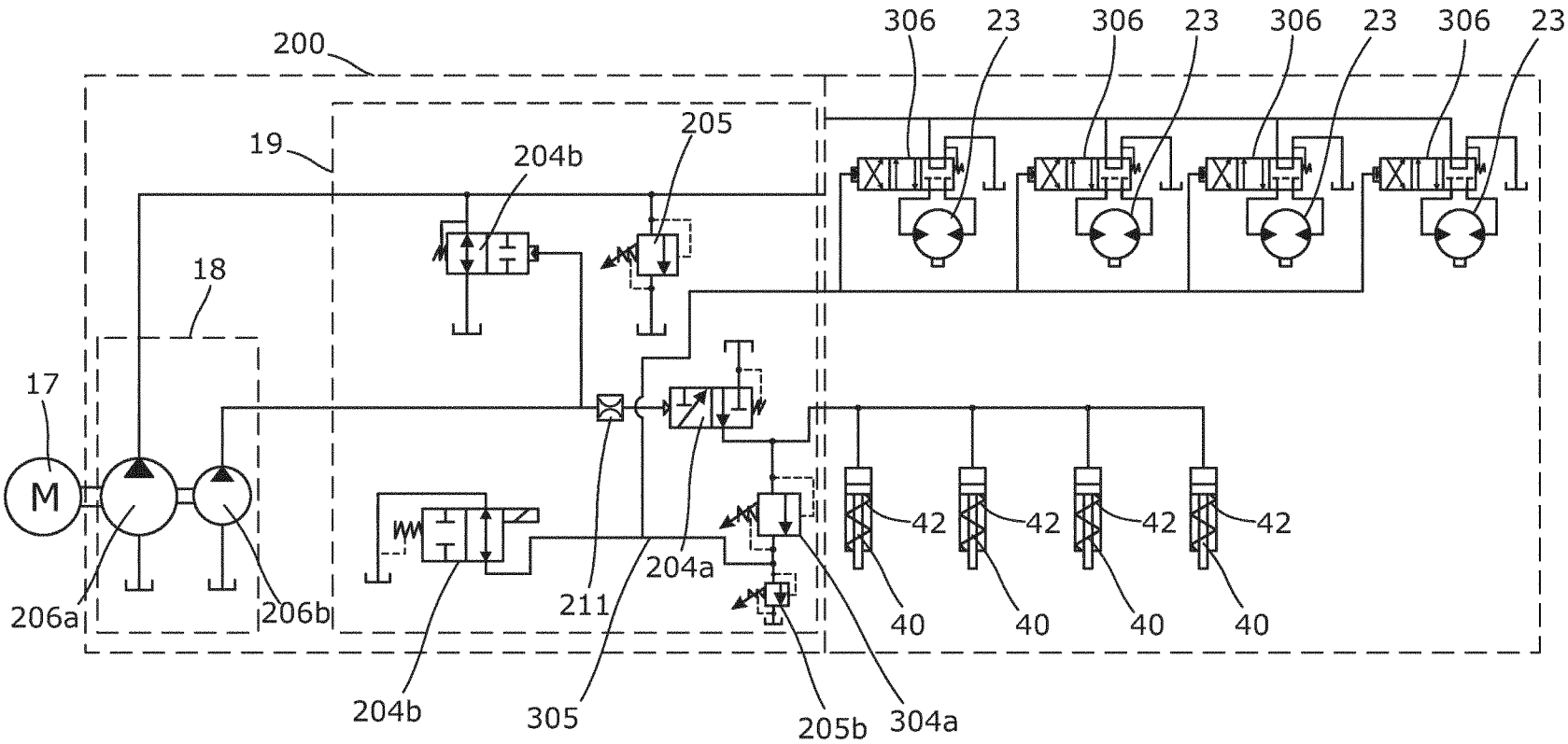

FIGS. 2 and 5*d* show a hydraulic assembly 200 furthermore comprising a second sequential valve 204*b* and an orifice 211. In this hydraulic assembly the fluid connection 203*b* is fluidly connected to the first sequential valve 204*a* through the orifice 211 to the second hydraulic piston 206*b*. Furthermore, the second fluid 208 is fluidly connected to the second sequential valve 204*b* through a second pressure channel 203*e*, enabling the second sequential valve 204*b* to be open when the second pressure of the second pressurised fluid 208 is below a rotation start pressure controlled by the second sequential valve 204*b* and closed when the second pressure exceeds the rotation start pressure. By introducing the second sequential valve 204*b* and the second pressure channel 203*e*, the projection of the arm assembly and the rotation of the wheels 62 may be initiated gradually in order to gradually burden the electrical motor 17 driving the hydraulic pump 18. Furthermore, the full driving force from the first fluid 207 will not be exploited before the wheels 62 fully engage the borehole or the production casing, so that the movement of the entire tool string also initiates gradually and not in an abrupt jerk.

According to a method of the present invention, the hydraulic pump 18 is initially activated in order to generate the first and second pressurised fluids illustrated in FIGS. 2 and 5*d*. Initially, the first fluid 207 is led directly through an open second sequential valve 204*b* and into the hydraulic chamber 202. The second fluid 208 is forced through the orifice 211 into the first sequential valve 204*a*, which is activated gradually due to the resistance of the orifice 211. Upstream of the orifice 211, the second pressure will gradually build up, applying more and more pressure to the second sequential valve 204*b* which gradually starts to close, forcing the first fluid 207 towards the hydraulic motor 23 activating rotation of the wheels 62. When the first fluid 207 has sufficiently filled the first sequential valve 204*a*, the first sequential valve 204*a* closes and the first pressure 207 starts to build up, thereby activating the arm activation assembly 40. When the arm assembly 40 finally engages the inner wall of the borehole or the production casing, the second pressure will quickly build up, thereby quickly closing the second sequential valve 204*b* completely. When the second sequential valve 204*b* is closed completely, all of the first fluid 207 will be forced to enter the hydraulic motor. The first pressure will therefore quickly after that increase towards a maximum first pressure driving the hydraulic motor with the maximum possible power.

One advantage of rotating the wheels prior to engaging the borehole wall or production casing when using hydraulic motors is their potential zero rotation torque, which presents a possible jamming situation in the borehole. When the wheels are engaging the borehole wall without rotating, they may be unable to begin rotation, since the wheels have to overcome an additional frictional force stemming from the normal force applied towards the borehole wall or production casing when the arm assembly is in its projecting position. Furthermore, when working several kilometers downhole, the power for driving the electrical motor and thus the hydraulic pump driving the hydraulic motors is very limited due to large voltage drops in a long wireline. Therefore, the initial movement of the tool string is critical due to the need for building up inertia of the tool string.

Figure 3:
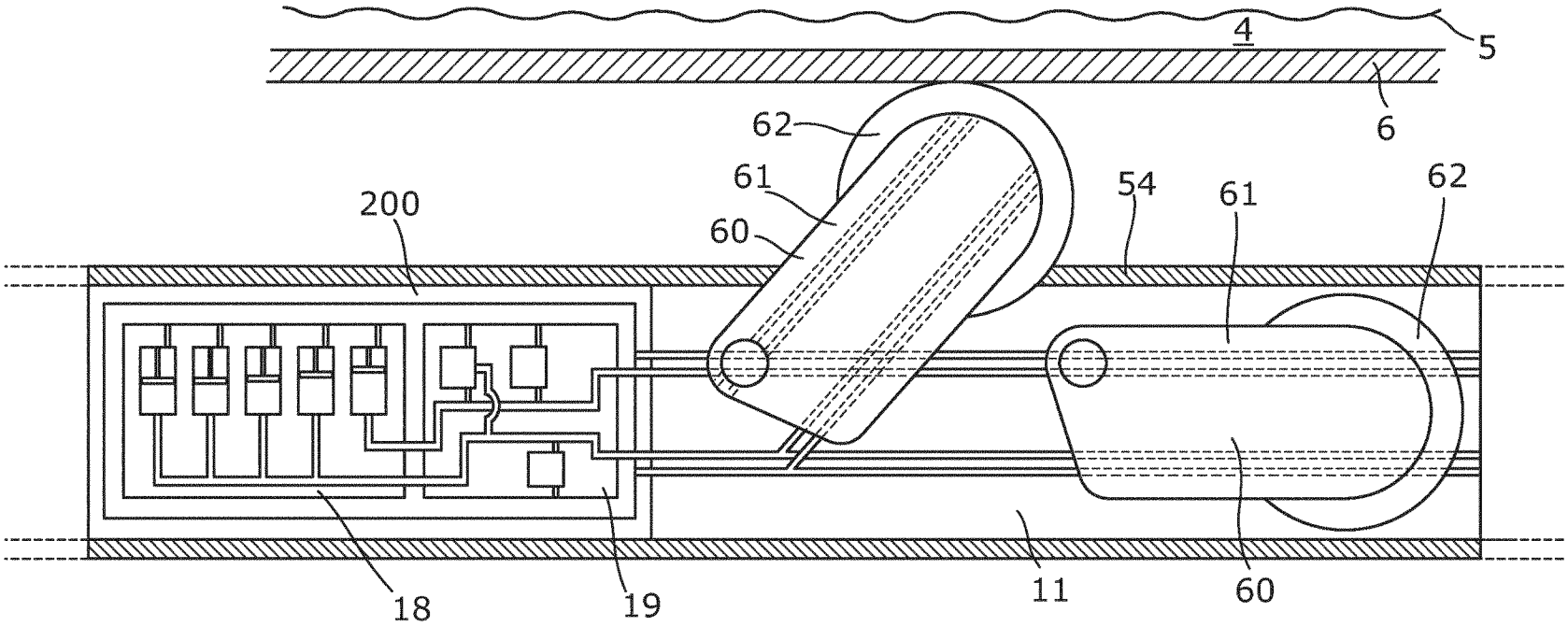
FIG. 3 shows a cross-sectional view of part of a downhole tool.

FIG. 3 shows an illustration of a hydraulic assembly 200 connected to a driving unit 11 with one arm assembly in the projecting position and another arm assembly 60 in the retracted position. The arm assembly 60 comprises an arm member 61 and furthermore the wheel 62 for driving the tool string during downhole operations. During downhole operations, the arm assemblies of the downhole tool would typically all be in a projecting or a retracted position. Furthermore, several driving units 11 may be connected to the same hydraulic assembly 200. Connecting more than one driving unit to the same hydraulic assembly 200 may typically be done fluidly in parallel in order to obtain synchronous behaviour of the driving units. In this way, each arm assembly of all driving units is supplied with substantially the same pressure, and each wheel of all driving units is rotated by substantially the same pressure. In FIG. 3, an arm member 61 (the one to the left) of the arm assembly 60 is seen in the projecting position and, in this situation, engaging an inner wall of a production casing 6, and an arm member 61 (the one to the right) is seen in its retracted position. Furthermore it is shown that an elongate axis of the arm member 61 has an angle of projection of less than ninety degrees with respect to the longitudinal axis of the tool string. In this way, the retraction of the arm assembly will not have a barbing function when pulling the wireline 9 or coiled tubing 9. Pulling the wireline or coiled tubing will therefore contribute to the retraction of the arm assembly if the projection angle is less than ninety degrees.

The hydraulic motor 23 used to drive the wheels 62 of the driving unit 11 may be arranged inside the wheel 62 of the arm assembly 60 or arranged inside a housing of the driving unit and then connected with the wheel by connecting means (not shown) such as a belt drive arranged in the arm assembly 60.

The downhole tool string 10 shown in FIG. 4 comprises the electrical motor 17 for moving the hydraulic pump 18. The electric motor 17 may be powered from the surface by a wireline 9 or, alternatively, the electric motor may be powered by batteries (not shown) arranged in the tool string. During coiled tubing operations well-known to any person skilled in the art, the hydraulic pump may be replaced by a hydraulic pump at the surface generating a pressurised fluid at the surface which is pumped through a coiled tubing 9 to the downhole tool string. Coiled tubing operations are typically limited to smaller depths of boreholes due to the weight of the coiled tubing. At very large depths, wireline operations are therefore more appropriate than coiled tubing operations. In FIG. 4, the tool string 10 furthermore comprises a top connector 13, a bottom connector 14, modeshift electronics 15 and controlling electronics 16.

FIGS. 5*a-d* show five different hydraulic diagrams of different embodiments of hydraulic assemblies according to the invention. Special requirements for a special downhole operation may exist, and thus a specific sequential valve system is set up to accommodate these special needs.

FIG. 5*b* shows a hydraulic diagram of a hydraulic assembly, wherein the hydraulic block 19 comprises two sequential valves 204, three filters 210, a check valve 213, a throttle 212 and two overpressure valves 205. Initiating the hydraulic pump 18 pressurises the first 207 and second 208 fluids. The first fluid is led directly back to the hydraulic chamber 202 since a second sequential valve is open in its initial position. The second fluid is led partially through a throttle 212 and partially through a check valve 213. When the second pressure increases, a first sequential valve 204*a* closes a passage for the second fluid directly to the hydraulic chamber 202. When the first sequential valve 204*a* starts to close, the second fluid is directed towards the arm activation assembly 40, whereby the arm activation assembly starts to project the arm assembly as the second pressure increases. Furthermore, when the second pressure increases, the second sequential valve is activated by the second fluid and will then close. When the second sequential valve closes, the first pressure starts to increase and the rotation of the hydraulic motor 23 will be activated, thereby rotating the wheels. Using this setup, the activation of the projection of the arm assembly will occur stepwise to make the load on the electrical motor driving the hydraulic pump increase gradually.

In FIG. 5*c*, the principle is very similar to the one shown in FIG. 5*b*. In FIG. 5*c*, the second fluid is not directed through a throttle 212 but the first sequential valve is controlled by a solenoid 214, which may be controlled to be activated with the activation of the electrical motor 17 or be controlled by controlling electronics 16 in the tool string 10. The initiation of the solenoid may be from a fixed time delay after the activation of the electrical motor 17 or controlled using other input signals to the controlling electronics such as pressure sensors (not shown).

The hydraulic diagram shown in FIG. 5*d* is also very similar to the hydraulic diagram shown in FIG. 5*b*. The difference is the arrangement of the throttle 212, which in FIG. 5*d* is arranged upstream of the first sequential valve 204*a*. Arranging the throttle in this position ensures that all power generated by the second piston 206*b* of the hydraulic pump 18 is led through the arm activation assembly 40, so that the maximum possible projection force is obtained. In the hydraulic diagram shown in FIG. 5*b*, a small fraction of the second fluid will be led directly back to the hydraulic chamber 202 and will therefore not participate in the projection of the arm assembly 60. In FIG. 5*d*, it is also shown how several wheels and arm activation assemblies 40 may be synchronously activated when arranged in parallel. In FIG. 5*d*, four arm activation assemblies 40 and four hydraulic motors 23 are connected in parallel for synchronous action.

As shown in FIG. 5*d*, the hydraulic motors 23 may be bi-directional and controlled by a directional valve 306. The directional valve 306 may be controlled by the first fluid through a pilot connection 305, so that the direction of rotation of the hydraulic motor may be controlled by the first fluid to be in a forward or reverse mode. In order to control the direction of rotation of the hydraulic motors after projection of the arm assembly 60, additional valves 204*b*, 205*b*, 304*a* may be used to control a direction changing sequence after projection of the arm assembly. The directional valves 306 may be arranged in the wheel arm 61 or wheel 62, as shown schematically in FIG. 5*d*, so that only one second fluid channel has to come through the arm activation assembly 40. This is an advantage since the second fluid provides the driving force and is therefore a relatively large channel. The pilot connection 305 with the first fluid may be very small, only large enough to provide enough first fluid to activate the directional valve 306. If the directional valve is alternatively arranged in the hydraulic control block 19, two separate channels carrying the second fluid have to be led through the arm activation assembly to the wheel, one for forward motion and one for reverse motion, which would require more space in the arm activation assembly 40 and wheel arm 61.

Furthermore, the second fluid may be led through an anti-spin valve reducing the fluid flow to the hydraulic motor and prevent the wheel from spinning. Thus, the the arm assembly 60 may further comprise an anti-spin valve. The anti-spin valve controls the flow through the fluid channel to ensure traction between the wheel and the side wall of the well or casing. When traction is substantially lost, the wheel rotates without providing the necessary forward motion of the downhole tool or tool string. When this happens, the flow through the hydraulic motor increases and the pressure consequently drops. To prevent spinning, the anti-spin valve restricts the flow through the channel whereby the rotational speed of the wheel is reduced and traction regained.

When the pressure in the hydraulic motor drops due to spinning of the wheel, the pressure in the hydraulic motor and a spring force in the anti-spin valve is no longer adequate to keep the anti-spin valve in the open position, and the flow through the anti-spin valve is at least partly restricted.

A sequential valve 204*a*, 204*b* may be any type of valve capable of controlling a sequence of fluid flows. The opening and closing of the valve may be controlled by a pressure, a temperature, an electrical switch, a mechanical interaction or the like. The sequential valves 204*a*, 204*b* may be magnetic valves. The combination of overpressure valves 205*b*, 209 may be replaced by a proportional valve. The combination of the first sequential valve 204*a* and solenoid 214 may be replaced by a proportional valve.

The hydraulic block may further comprise adjustable means for controlling the overpressure valves 209, filters 210 for filtering the hydraulic entering the driving unit, orifices 211, throttles 212, check valves 213, solenoids 214 and/or electrical sensors (not shown) for monitoring the first and second pressures for producing a feedback signal to a control system.

Although the invention has been described in the above in connection with preferred embodiments of the invention, it will be evident for a person skilled in the art that several modifications are conceivable without departing from the invention as defined by the following claims.

The invention claimed is:

1. A downhole tool, comprising:

a hydraulic assembly, an arm assembly, the arm assembly comprising a wheel, the arm assembly being movable between a retracted position and a projecting position in relation to a tool housing;

a hydraulic motor configured to rotate the wheel, rotation of the wheel being adapted to drive the downhole tool within a wellbore downhole;

a hydraulic pump unit configured to generate a first pressurized fluid stream at a first pressure and a second pressurized fluid stream at a second pressure, the first pressure being variable compared to the second pressure;

an arm activation assembly configured to move the arm assembly between the retracted position and the projecting position, the hydraulic motor being configured to rotate the wheel to drive the downhole tool when the arm assembly is in the projecting position, the arm activation assembly being in fluid connection with the first pressurized fluid stream and the hydraulic motor being in fluid connection with the second pressurized fluid stream;

a hydraulic control block adapted to control the pressure of the first pressure and the second pressure; and, the hydraulic control block comprising a sequential valve configured to control a sequence of retraction of the arm assembly, a projection of the arm assembly and a rotation of the wheel;

wherein the sequential valve is fluidly connected with one of the fluid streams and changes between an open and a closed position based upon the variable pressure of the other fluid stream.

2. The downhole tool according to claim 1, wherein the first pressurized fluid stream and the second pressurized fluid stream are reunited downstream from the arm activation assembly and the hydraulic motor, respectively, into a downstream fluid entering a hydraulic chamber connected with the hydraulic pump in a closed circuit.

3. The downhole tool according to claim 2, wherein the hydraulic assembly comprises a hydraulic assembly housing being the hydraulic chamber.

4. The downhole tool according to claim 3, wherein the hydraulic block and the hydraulic pump are contained in the hydraulic assembly housing.

5. The downhole tool according to claim 1, wherein the sequential valve is fluidly connected with the second pressurized fluid stream and changes between an open and a closed position based upon the pressure of the first pressurized fluid stream.

6. The downhole tool according to claim 1, wherein the sequential valve is fluidly connected with the first pressurized fluid stream and changes between an open and a closed position based upon the pressure of the second pressurized fluid stream measured upstream of a throttle.

7. The downhole tool according to claim 1, wherein the first pressurized fluid stream is in fluid communication with a direction valve through a pilot connection, the hydraulic motor having first and second inlet ports, the direction valve controlling the second fluid stream entering in the first or the second inlet ports of the hydraulic motor, so that a direction of rotation of the hydraulic motor may be controlled by the first pressurized fluid stream to be in a forward or reverse mode.

8. The downhole tool according to claim 1, wherein the hydraulic control block is configured to rotate the wheel before projection of the arm assembly.

9. The downhole tool according to claim 8, wherein the hydraulic control block is configured to rotate the wheel before the wheel engages a borehole wall or a production casing.

10. The downhole tool according to claim 1, wherein the first pressurized fluid stream exits the hydraulic pump unit at the first pressure, and the second pressurized fluid stream exits the hydraulic pump at the second pressure.

11. A downhole system comprising the downhole tool according to claim 1 and an operational tool connected with the downhole tool for being moved forward in a well or borehole.

12. A method of controlling a projection of an arm assembly of a driving unit of a downhole tool, comprising activation of a hydraulic pump, simultaneous generation of a first pressurized fluid stream having a first pressure and a second pressurized fluid stream having a second pressure, the first pressure being variable compared to the second pressure;

activation of a rotation of a hydraulic motor by the first pressurized fluid stream, which in turn drives a wheel of the arm assembly, increasing the first pressure until the first pressure reaches a predetermined projection pressure;

activating an arm activation assembly by a first sequential valve; and activating a projection of the arm assembly by the second pressure of the second pressurized fluid stream.

13. The method according to claim 12, further comprising:

forcing the second pressurized fluid stream through an orifice and into a first sequential valve, thereby gradually closing the first sequential valve and replacing the step of activation of an arm activation assembly by the first sequential valve;

increasing the second pressure upstream of the orifice;

gradually closing a second sequential valve by increasing the second pressure of the second pressurized fluid stream;

increasing the first pressure of the first pressurized fluid stream, replacing the step of increasing the first pressure until the first pressure reaches a predetermined projection pressure;

increasing the second pressure further when the wheel of the arm assembly abuts an inner wall of the borehole or production casing;

closing the second sequential valve by the second pressure;

further increasing the first pressure of the first pressurized fluid stream until a maximum pressure of the first pressure of the first pressurized fluid stream is obtained; and driving a tool string in a forward direction.

14. The method according to claim 12, wherein the activation of the projection of the arm assembly occurs when the pressure of the second pressurized fluid stream surmounts a spring force applied to the arm activation assembly by a spring member.

15. The method according to claim 12, further comprising deactivation of a hydraulic pump;

deactivation of a projection of the arm assembly by a decrease of the second pressure of the second pressurized fluid stream;

decreasing the second pressure until the arm assembly is retracted; and decreasing a rotation of a hydraulic motor by decreasing the first pressure of the first pressurized fluid stream driving a wheel of the arm assembly in which the hydraulic motor is arranged.

16. The method according to claim 15, wherein the activation of the retraction of the arm assembly occurs when the pressure of the second pressurized fluid stream becomes inferior to a spring force applied to the arm activation assembly by a spring member.

17. The method according to claim 12, further comprising:

driving the downhole tool in a forward direction;

deactivation of the hydraulic pump;

deactivation of the projection of the arm assembly by decreasing the second pressure of the second pressurized fluid stream;

decreasing the second pressure until the arm assembly is retracted; and decreasing the rotation of the hydraulic motor by decreasing the first pressure of the first pressurized fluid stream.

18. The method according to claim 12, further comprising:

activation of an arm activation assembly by the second pressurized fluid stream instead of by a first sequential valve;

increasing the second pressure when a wheel of the arm assembly abuts an inner wall of the borehole or production casing, replacing the step of increasing the first pressure until the first pressure reaches a predetermined projection pressure; and increasing the second pressure until the second pressure reaches a predetermined rotation pressure;

wherein the step of activation of a rotation of a hydraulic motor by the first pressurized fluid stream for driving the wheel of the arm assembly is performed by a first sequential valve, driving the downhole tool in a forward direction;

deactivation of the hydraulic pump;

decreasing the rotation of the hydraulic motor by decreasing the first pressure of the first pressurized fluid stream;

deactivation of a projection of the arm assembly by decreasing the second pressure of the second pressurized fluid stream; and decreasing the second pressure until the arm assembly is retracted.

19. The method according to claim 12, wherein the first pressurized fluid stream is configured to rotate the wheel before the second pressurized fluid stream projects the arm assembly.

20. The method according to claim 19, wherein the first pressurized fluid stream is configured to rotate the wheel before the wheel engages a borehole wall or a production casing.

* * * * *